US011664041B2

(12) United States Patent
Ganeshkumar

(10) Patent No.: US 11,664,041 B2
(45) **Date of Patent: *May 30, 2023**

(54) PERSONAL AUDIO DEVICE

(71) Applicant: Bose Corporation, Framingham, MA (US)

(72) Inventor: Alaganandan Ganeshkumar, North Attleboro, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/467,833

(22) Filed: Sep. 7, 2021

(65) Prior Publication Data

US 2021/0407529 A1 Dec. 30, 2021

Related U.S. Application Data

(63) Continuation of application No. 16/778,541, filed on Jan. 31, 2020, now Pat. No. 11,145,319.

(51) Int. Cl.

| | |
|---|---|
| ***G10L 21/0232*** | (2013.01) |
| ***H04R 3/00*** | (2006.01) |
| *G10L 21/0216* | (2013.01) |

(52) U.S. Cl.

CPC ..... *G10L 21/0232* (2013.01); *H04R 3/005* (2013.01); *G10L 2021/02166* (2013.01); *H04R 2410/07* (2013.01)

(58) Field of Classification Search

CPC ..... H04R 2225/43; H04R 1/105; H04R 2460/01; G10L 21/0232

USPC ..... 381/381, 94.7, 94.2, 317

See application file for complete search history.

(56) References Cited

U.S. PATENT DOCUMENTS

| | | | | |
|---|---|---|---|---|
| 11,032,631 | B2 * | 6/2021 | Kumari | H04R 29/001 |
| 2015/0301338 | A1 * | 10/2015 | Van Heugten | G09G 3/32 345/8 |
| 2018/0032875 | A1 * | 2/2018 | Bostick | G06Q 10/0833 |
| 2018/0081448 | A1 * | 3/2018 | Woo | G06F 3/017 |
| 2018/0324512 | A1 * | 11/2018 | Ono | H04R 1/086 |

* cited by examiner

*Primary Examiner* — Alexander Krzystan
(74) *Attorney, Agent, or Firm* — Bose Corporation

(57) ABSTRACT

A personal audio device configured to be worn on the head or body of a user and including a plurality of microphones configured to provide a plurality of separate microphone signals capturing audio from an environment external to the personal audio device, and a processor configured to process a first subset of the plurality of separate microphone signals using a first array processing technique to provide a first array signal, compare the first array signal to a microphone signal from the plurality of separate microphone signals, and select the first array signal or the microphone signal based on the comparison.

16 Claims, 4 Drawing Sheets

PERSONAL AUDIO DEVICE

CROSS-REFERENCE TO RELATED APPLICATION

This application is a continuation of and claims priority to application Ser. No. 16/778,541, filed on Jan. 31, 2020.

BACKGROUND

This disclosure relates to an audio device that is configured to be worn on the head or body of a listener.

Headphones and other personal audio devices can include one or more microphones. The microphones can be used to pick up the user's voice, for example for use in a telephone call or to communicate with a virtual personal assistant. If the user is outside or in motion, wind noise can negatively impact the ability of the microphones to pick up the user's voice.

SUMMARY

All examples and features mentioned below can be combined in any technically possible way.

In one aspect, a personal audio device configured to be worn on the head or body of a user includes a plurality of microphones configured to provide a plurality of separate microphone signals capturing audio from an environment external to the personal audio device. The personal audio device further includes a processor that is configured to process a first subset of the plurality of separate microphone signals using a first array processing technique to provide a first array signal, compare the first array signal to a microphone signal from the plurality of separate microphone signals, and select the first array signal or the microphone signal based on the comparison.

Some examples include one of the above and/or below features, or any combination thereof. In an example the comparison of the first array signal to a microphone signal comprises comparing an energy level of the first array signal to an energy level of the microphone signal. In an example the comparison of the energy level of the first array signal to the energy level of a microphone signal takes place in only part of a frequency range of the microphones. In an example the processor is further configured to make a determination whether the energy level of the first array signal is greater than the energy level of the microphone signal by at least a threshold amount. In an example the processor is further configured to select an accelerometer signal if an energy level of the first array signal and all of the separate microphone signals are above a threshold level.

Some examples include one of the above and/or below features, or any combination thereof. In an example the processor is further configured to compare the first array signal to each of the microphone signals from the plurality of separate microphone signals. In an example the processor is further configured to select the first array signal or a microphone signal of the separate microphone signals based on the comparison. In an example selection is based on an energy level of the first array signal and an energy level of each of the separate microphone signals. In an example if the energy level of the first array signal is greater than the energy level of any of the separate microphone signals, the processor is configured to select a microphone with an energy lower than that of the first array. In an example if the energy level of the first array signal is greater than the energy level of any of the separate microphone signals, the processor is configured to select the microphone with the lowest energy.

Some examples include one of the above and/or below features, or any combination thereof. In an example the processor is further configured to blend the first array signal and the microphone signal based on the comparison. In an example the processor is further configured to make a determination whether the energy level of the first array signal is greater than the energy level of the microphone signal by at least a threshold amount. In an example the processor is configured to blend the first array signal and the microphone signal when the energy level of the first array signal is greater than the energy level of the microphone signal by least the threshold amount. In an example the blending takes place over a predetermined time period. In an example after the predetermined time period the blending ceases.

Some examples include one of the above and/or below features, or any combination thereof. In an example the processor is further configured to process a second subset of the plurality of separate microphone signals to provide a second array signal based on the comparison, the first subset of the plurality of separate microphone signals being different from the second subset of the plurality of separate microphone signals. In an example the second array signal is generated using a second array processing technique that is different than the first array processing technique.

Some examples include one of the above and/or below features, or any combination thereof. In an example the personal audio device further includes a support structure that is configured to be coupled to an ear of the user and an acoustic module coupled to the support structure and configured to be located anteriorly of the ear, wherein there are at least two microphones carried by the acoustic module and at least one microphone carried by the support structure, wherein the support structure comprises an end spaced farthest from the acoustic module and the at least one microphone carried by the support structure is located proximate the end.

In another aspect a computer program product having a non-transitory computer-readable medium including computer program logic encoded thereon that, when performed on a personal audio device that is configured to be worn on the head or body of a user and comprises a plurality of microphones configured to provide a plurality of separate microphone signals capturing audio from an environment external to the personal audio device, causes the personal audio device to process a first subset of the plurality of separate microphone signals using a first array processing technique to provide a first array signal, compare the first array signal to a microphone signal from the plurality of separate microphone signals, and select the first array signal or the microphone signal based on the comparison.

Some examples include one of the above and/or below features, or any combination thereof. In an example the computer program product is further configured to cause the personal audio device to compare the first array signal to each of the microphone signals from the plurality of separate microphone signals, and select the first array signal or a microphone signal of the separate microphone signals based on an energy level of the first array signal and an energy level of each of the separate microphone signals, wherein if the energy level of the first array signal is greater than the energy level of any of the separate microphone signals a microphone with an energy lower than that of the first array is selected.

DETAILED DESCRIPTION

Personal audio devices are configured to be worn on the head or body of the user. In some examples personal audio devices include one or more microphones. The microphones are typically configured to pick up the user's voice. In some cases multiple microphones are used in an array to steer a beam toward the user's mouth in order to enhance speech pickup from the user. Beamforming is one microphone array signal processing technique that can be used to steer a beam. Other microphone array signal processing techniques such as null steering and delay-and-sum can be used to enhance pickup of the user's voice. Beamforming, null steering, delay-and-sum and other array processing techniques are described in U.S. Patent Application Publication 2018/0270565, the entire disclosure of which is incorporated herein by reference for all purposes.

Personal audio devices are typically relatively small. The multiple microphones that are arrayed in beamforming are sometimes relatively close together. In windy conditions, substantial low frequency noise may be included in the microphone signals. At low frequencies the output signals from microphones that are close together may be similar due to the long wavelength of sound at low frequencies. Beamforming and other directional processing techniques can involve subtraction of microphone signals. When two similar signals are subtracted, the difference signal will have a low amplitude. Substantial gain then needs to be applied in order to bring the signal amplitude to the necessary level. The gain can lead to substantial amplification of the wind noise. Accordingly, beamforming in windy conditions can cause an unacceptable level of wind noise in microphone signals.

In some examples herein, when wind noise is present in a beamformed microphone array the audio device is configured to determine whether there is a different microphone array or a single microphone that has less wind noise than the beamformed array, and switch to that different array or microphone until the wind noise subsides. In some examples the wind noise is estimated from the energy level of the beamformer and the individual microphone outputs. When the energy level of the beamformer output is greater than that of an individual microphone, the output can be switched to the lowest-energy microphone. If there is more than one microphone with an energy level less than the beamformer output these microphones can potentially be used in a different array.

Figure 1:
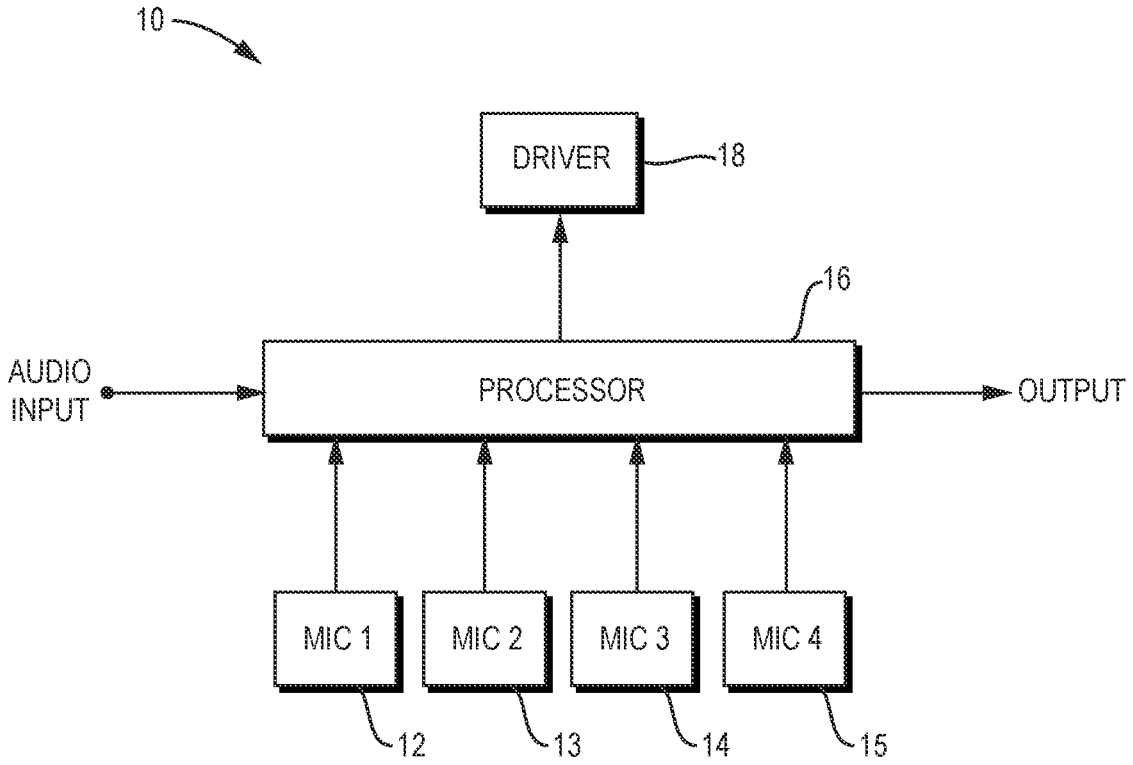
FIG. 1 is a schematic diagram of a personal audio device.

FIG. 1 is a schematic diagram of personal audio device 10. Personal audio device 10 includes more than one microphone. The microphones can be used to pick up the user's voice. Voice pickup with microphones of a personal audio device is known in the field and can be used for various purposes, such as telephone calls and communication with a virtual personal assistant (VPA). In this example there are four microphones (mics 1-4, numbered 12-15, respectively). The quantity of microphones is not a limitation of this disclosure, and there can be fewer than or more than four. In some examples the quantity of microphones and the locations of the microphones that are part of the personal audio device are selected to achieve desired results given the form factor of the device. For example, microphones take up space on the device and must be properly wired and so their quantity and locations can be constrained by the personal audio device design. There may be other practical and aesthetic reasons for limiting the quantity and placement of microphones. For beamforming, it is most desirable to have two or more microphones that lie generally along an axis from the expected location of the user's mouth. These microphones can be arrayed to steer a beam toward the expected location of the user's mouth.

The outputs of microphones 12-15 are provided to processor 16. Processor 16 may be configured to perform computer-executable instructions that accomplish processing of the microphone signals. In some examples processor 16 is configured to process a first subset of the signals from microphones 12-15 (the subset comprising two or more of the microphones) using a first array processing technique to provide a first array signal. In an example this array processing technique is minimum variance distortionless response (MVDR) beamforming, although other array processing techniques can be used. Processor 16 is configured to compare the first array signal to one or more of the separate signals from microphones 12-15, and select the first array signal or a microphone signal based on the comparison. In some examples the comparison is between the array output and the outputs of each of the microphones that are part of the array. In another example the comparison is to any one of the microphones individually, or to each of the audio device microphones individually. An aim of the comparison is to select for outputting a signal that has a relatively low contribution from wind noise. The selected signal can then be outputted, e.g., to a cell phone or another receiving device. In an example processor 16 is configured to equalize all of the microphones to the user's voice before the microphone signals are beamformed and compared. Processor 16 is typically also enabled to process and output other audio signals, the sources of which can be variable, for example from user audio files or from internet sources such as Spotify® and Pandora®, which can be passed to driver (transducer) 18 to be outputted to the user.

In some examples the comparison of the first array signal to a microphone signal is based on comparing an energy level of the first array signal to an energy level of the microphone signal. Without substantial contribution from wind noise, the output energy of an MVDR beamformer tends to be less than the output energy of any single microphone used in the beamformer. In some examples the array will have an output energy perhaps 6-8 dB less than any of the single microphones of the microphone array. With added wind noise the array output energy can climb above that of one or more than one of the single microphones. As described above, wind noise may be most problematic in a low frequency range, which in an example is less than 1 KHz. In an example, the comparison of the energy level of the first array signal to the energy level of a microphone signal takes place in only part of a frequency range of the microphones, for example this low-frequency range. Because the low frequency range is more susceptible to wind noise, conducting the energy comparison in this frequency range may be more effective in mitigating wind noise in the output signal heard by the user as compared to an energy level comparison across a different or broader frequency range, or a comparison that is not limited in its frequency range.

In some examples if the energy level of the first array signal is greater than the energy level of any of the separate microphone signals, the processor is configured to select a microphone with an energy lower than that of the first array. In an example, if the energy level of the first array signal is greater than the energy level of any of the separate microphone signals, the processor is configured to select the microphone with the lowest energy. This may help to provide an output that has a lower contribution of wind noise.

In some examples the processor is configured to make a determination of whether the energy level of the first array signal is greater than the energy level of a microphone signal by at least a threshold amount. A threshold can be useful to help avoid rapid switching back and forth between the array output and a microphone output, when the energies of the array and the microphone are close together and not static. In some examples when the array output exceeds a microphone output by at least the threshold amount the output is switched from the array to the microphone. If and when the array output energy decreases below the microphone output, the output returns to that of the array. In some examples there can be a gradual change from the array to the microphone. A gradual change may be useful to help prevent rapid switching back and forth, and may also be useful to account for situations where the output energies are close, meaning that neither output is dramatically better than the other.

In an example a gradual change is accomplished by applying a weighting factor (e.g., multiplying the output by the weighting factor) to the array output and the microphone output and adding the two weighted outputs together. In an example when the wind is below the threshold (i.e., the array output energy is less than the output energy of any of the array microphones) the weighting factor is one for the array output and one minus one (i.e., zero) for the microphone output. Thus the output is only from the array. When the wind exceeds the threshold the weighting factor for the array gradually decreases to zero and the weighting factor for the microphone gradually increases to one. This means that the array and the microphone outputs are combined. If and when the wind then drops down below the threshold the weighting factor for the array gradually increases back to one and the weighting factor for the microphone gradually decreases back to zero. In an example the two weighting factors change by the same amount over time. The amount by which the weighting factors change and the time period over which they change can be selected during the device tuning process, to achieve a desired result.

In some examples the device can be configured to use as its output the outputs of two or more microphones that have less energy than the array. In an example if there are two or more microphones with less energy than the array, mixing of the microphone signals can result in less noise than any of the microphones alone. For example, when two microphones are mixed the mixed output can be about 3 dB better than either of the microphones alone. Mixing more than two microphones may further decrease any wind noise contribution. In some examples multiple separate microphones are selected based on a comparison of the output energies of all of the microphones that have an energy level less than that of the array. Multiple microphones may be arrayed (e.g., in a delay and sum operation), or mixed. When multiple microphones are arrayed the array is more effective if the energies of the microphones being arrayed are similar, e.g., within about +/−3 dB of each other.

In some examples when there are two or more microphones with less wind noise than the array the outputs of these microphones can be combined. In an example this combination can be in an array. In cases where these microphones can be successfully beamformed, a result can be that the beamformer uses a different combination of microphones when wind is detected in the original array. Since beamformed microphones generally should lie approximately along an axis from the expected location of the mouth, in some cases the microphones with energies less than that of the array may not be sufficiently aligned to be successfully beamformed. In an example where there are two or more microphones with energies less than the array but that are not aligned so as to be beamformed, the microphones can be arrayed in a different manner. In an example the microphones can be arrayed using a delay and sum approach. A delay and sum approach time aligns all the microphone signals to the desired speech direction, which when summed will reinforce. Since the wind noise is not reinforced by this process as it is not time aligned, the overall effect is an improvement in speech to noise ratio.

In an example where the personal audio device is used to communicate with a VPA that uses a wake word, a single microphone that is the least susceptible to wind noise due to its placement on the device is used to monitor for the wake word. For example the single microphone can be used as the input to a voice activity detector. In an example the arraying of multiple microphones takes place only after a wake word is detected. Such an operation can save battery power because only one microphone is always on.

Figure 2:
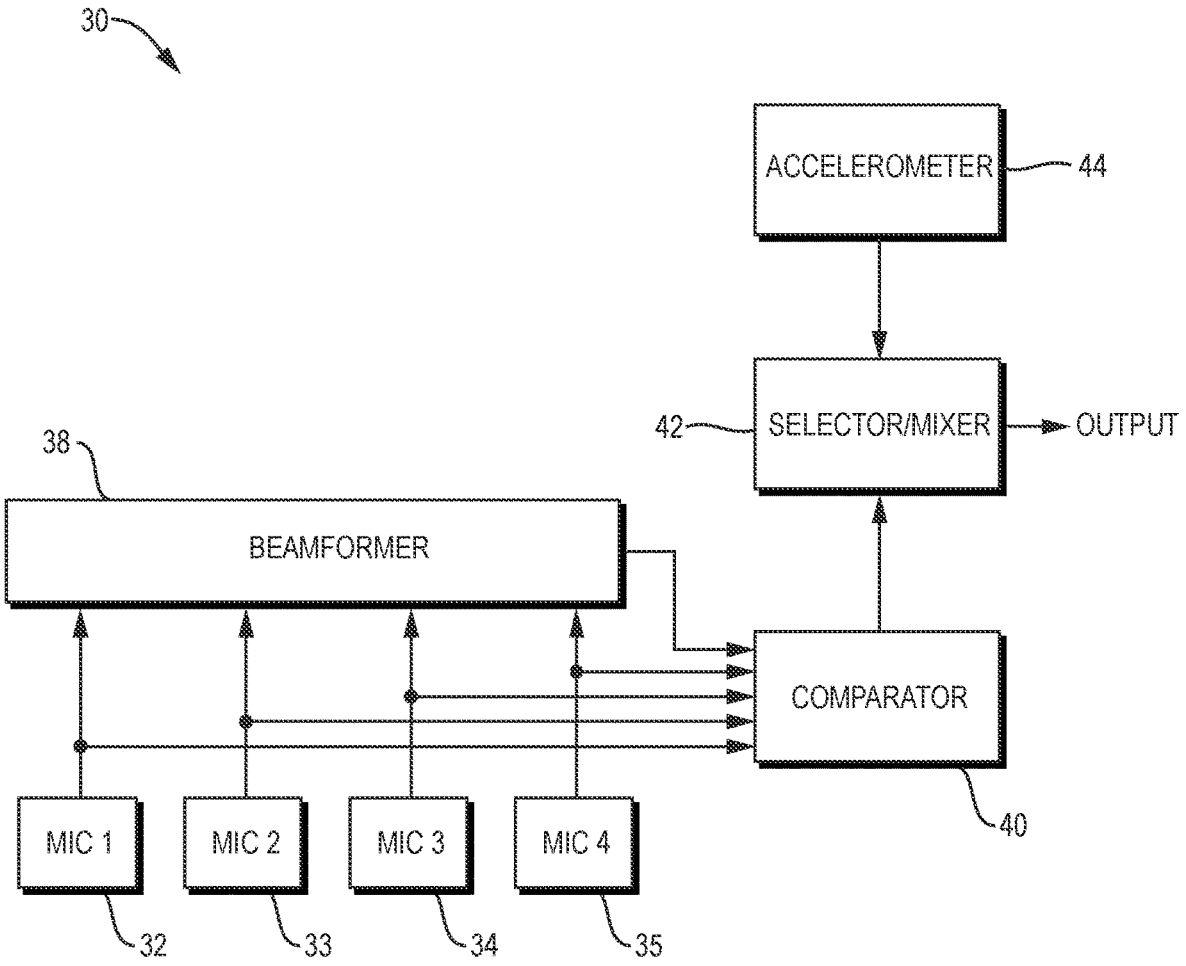
FIG. 2 is a schematic diagram of aspects of a personal audio device that are useful to improve the user's voice pickup in the presence of wind.

FIG. 2 is a schematic diagram of aspects of an example of a personal audio device 30 that are useful to improve the user's voice pickup in the presence of wind. The outputs of microphones 1-4 (numbered 32-35) are provided to beamformer 38 and comparator 40. The output of beamformer 38 is also provided to comparator 40. In an example comparator 40 is configured to compare the energy level of the beamformer output to the energy levels of each of the microphones. The output of comparator 40 can be any one or more of the beamformer output and the outputs of any one or more of individual microphones 32-25, as explained above. Selector/mixer 42 selects an output, or mixes two or more outputs as described above, and provides the appropriate output signal(s), which in an example are transmitted to another device, such as via a cellular telephone signal when the personal audio device is configured to communicate with the user's cell phone and thus be useful to conduct a telephone call. In an example beamformer 38, comparator 40, and selector/mixer 42 are accomplished with appropriate software running on a processor.

In an example the personal audio device is configured such that it provides an intelligible output signal even in the case of wind noise that overwhelms the outputs of all of the device microphones and the beamformer. One manner by which this result can be accomplished is to include an accelerometer 44 that is located such that it is able to detect the user's voice. Accelerometer 44 can be located on the personal audio device such that it contacts the user's body (for example, the head). Speech can be conducted to the accelerometer via bone conduction. Accelerometer 44 can thus be used to pick up the user's voice. Some accelerometers have a bandwidth of up to 2-3 kHz and so can be active in the speech frequency band. Selector/mixer 42 can be enabled to select the accelerometer output over the microphone and array outputs when there is a useful accelerometer output and the other outputs all exceed the wind threshold. If the accelerometer is susceptible to environmental noise a microphone that is relatively close to the accelerometer (which may or may not be one of microphones 32-35) can be used as a reference that is subtracted from the accelerometer output in order to reduce or cancel the noise. When such a microphone is used it may be best to configure it not to pick up the user's voice, or the accelerometer voice signal may be cancelled. In an example where the personal audio device comprises some type of head gear (for example, a helmet) the accelerometer and the reference microphone could be on the back of the helmet and head, where the influence of the user's voice would be expected to be minimal. For a personal audio device that is worn on or near the ears the accelerometer and the reference microphone could be located on the device housing facing towards the back of the user's head.

Elements of FIGS. 1 and 2 are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

Examples of the systems and methods described herein comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

Figure 3:
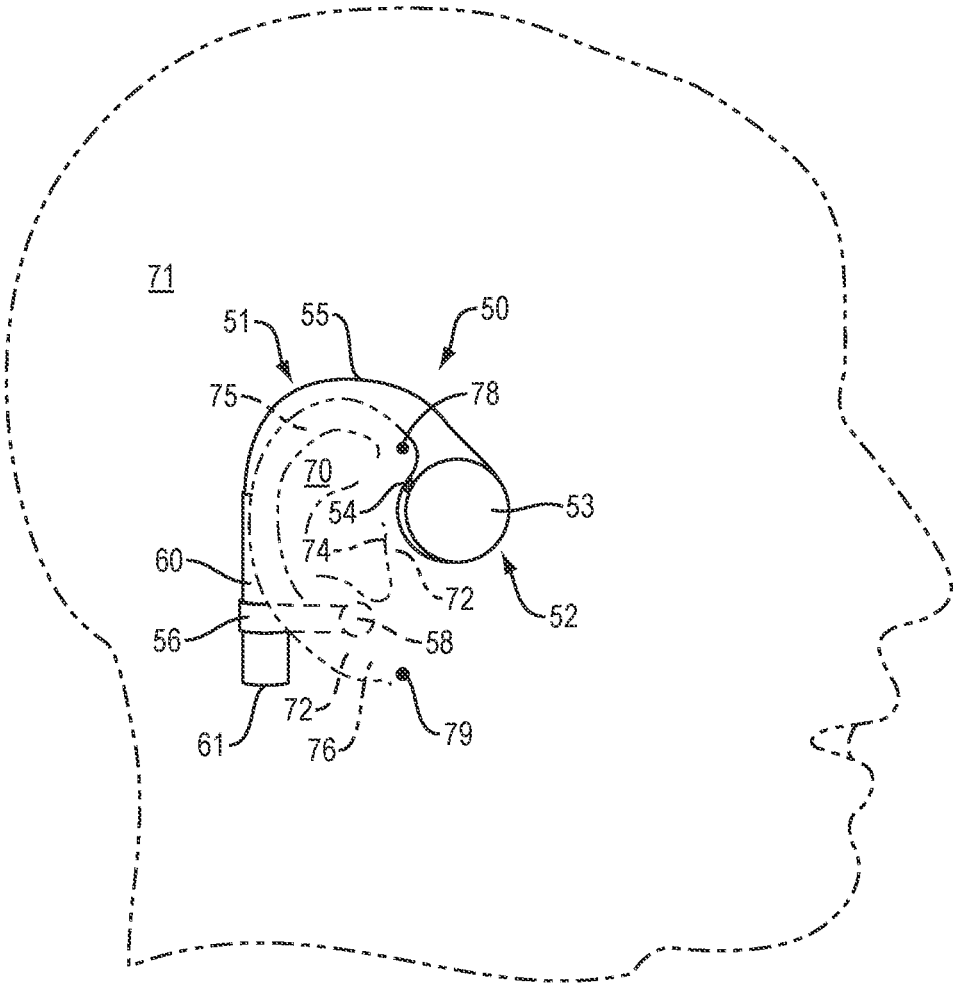
FIG. 3 is a front view of an open audio device mounted to the right ear of a user.
Figure 4:
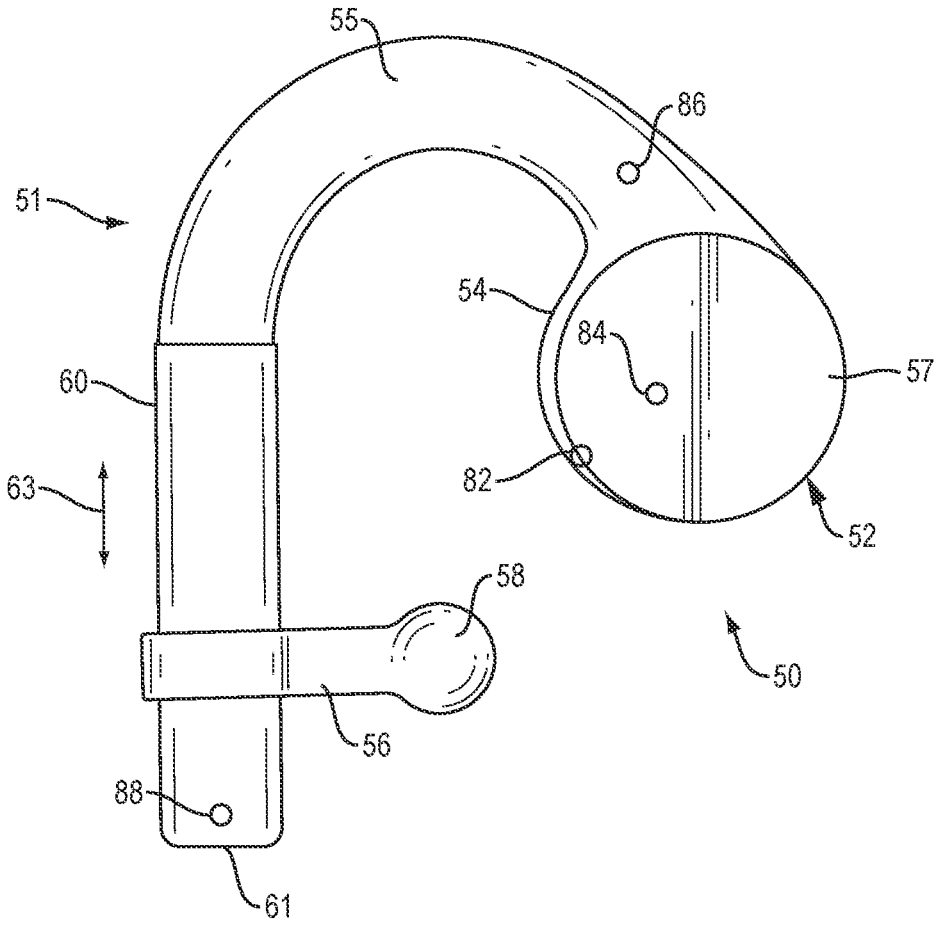
FIG. 4 is a rear view of the open audio device of FIG. 3.

Some examples of this disclosure describes a type of personal audio device that is known as an open audio device. Open audio devices have one or more electro-acoustic transducers that are located off of the ear. Open audio devices are further described in U.S. Pat. No. 10,397,681, the entire disclosure of which is incorporated herein by reference for all purposes. A headphone refers to a device that typically fits around, on, or in an ear and that radiates acoustic energy into the ear canal. Headphones are sometimes referred to as earphones, earpieces, headsets, earbuds, or sport headphones, and can be wired or wireless. A headphone includes an electro-acoustic transducer (driver) to transduce electrical audio signals to acoustic energy. The acoustic driver may or may not be housed in an earcup. FIGS. 3 and 4 and their descriptions show a single open audio device. A headphone may be a single stand-alone unit or one of a pair of headphones (each including at least one acoustic driver), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality, such as a microphone.

In an around the ear or on the ear or off the ear headphone, the headphone may include a headband or other support structure and at least one housing or other structure that contains a transducer and is arranged to sit on or over or proximate an ear of the user. The headband can be collapsible or foldable, and can be made of multiple parts. Some headbands include a slider, which may be positioned internal to the headband, that provides for any desired translation of the housing. Some headphones include a yoke pivotably mounted to the headband, with the housing pivotally mounted to the yoke, to provide for any desired rotation of the housing.

An open audio device includes but is not limited to an off-ear headphone, i.e., a device that has one or more electro-acoustic transducers that are coupled to the head or ear (typically by a support structure) but do not occlude the ear canal opening. In the description that follows the open audio device is depicted as an off-ear headphone, but that is not a limitation of the disclosure as the electro-acoustic transducer can be used in any device that is configured to deliver sound to one or both ears of the wearer where there are typically no ear cups and no ear buds. The audio device contemplated herein may include a variety of devices that include an over-the-ear hook, such as a wireless headset, hearing aid, eyeglasses, a protective hard hat, and other open ear audio devices.

Exemplary audio device 50, FIG. 3, is an open audio device. Audio device 50 is depicted mounted to an ear in FIG. 3 and is depicted off the ear (in a rear view) in FIG. 4. Audio device 50 is carried on or proximate outer ear 70. Audio device 50 comprises acoustic module 52 that comprises an acoustic radiator (driver/transducer, not shown) carried in a housing. Acoustic module 52 is configured to locate a sound-emitting opening 54 anteriorly of and proximate to the ear canal opening 74, which is behind (i.e., generally underneath) ear tragus 72. Acoustic module 52 includes front face 53. Acoustic modules (which may include one or more electro-acoustic transducers or drivers) that are configured to deliver sound to an ear are well known in the field and so are not further described herein.

Audio device 50 further includes body 51 that acts as a support structure that carries acoustic module 52 and is configured to be worn on or abutting outer ear 70 such that body 51 contacts the outer ear and/or the portion of the head 71 that abuts the outer ear. Arm 56 is coupled to body 51. Arm 56 is optional, but is one structure that can assist with holding audio device 50 on the ear. Arm 56 comprises a distal end 58 that is configured to contact the head or ear at or near the ear root dimple 77 of the user. Arm 56 may be but need not be configured to be moved in two directions, e.g., in a vertical direction or up-and-down direction along the length of body 51 and in a horizontal direction, pivoting about the axis of the body 51. In some implementations, arm 56 is compliant. The adjustability and compliance (in implementations where the arm is compliant) of the arm allows arm distal end 58 to be located at the bottom of the outer ear of people with different anatomies. Force provided in part by the compliance of the arm can cause the body and arm to gently grip the outer ear and/or the ear root dimple region when the audio device is worn in this manner. The grip helps to maintain audio device 50 on the ear as the user moves. Arm 56 can be adjustable to allow the user to adjust audio device 50 so it fits comfortably but firmly on the ear.

Body 51 can at least in part be shaped generally to follow the ear root, which is the intersection of the outer ear and the head. Contact along the ear root or the outer ear and/or the head abutting the ear root (collectively termed the ear root region) can be at one or more locations along the ear root. However, since the human head has many shapes and sizes, body 51 does not necessarily contact the ear root of all users. Rather, it can be designed to have a shape such that it will, at least on most heads, contact the ear root region, at least near the top of the ear. In implementations that include arm 56, the arm distal end can be configured to contact the lower part of the ear root region. Since, at least for most heads, the audio device with the arm may contact the ear/head at least at these two spaced locations, which are substantially or generally diametrically opposed, the result is a gripping force that maintains audio device 50 on the head as the head moves. For implementations where the arm is compliant, the compliance of the arm can cause a slight compressive force at the opposed contact locations and so can help achieve a grip on the head/ear that is sufficient to help retain the device in place on the head/ear as the head is moved. In one non-limiting example, one contact location is proximate the upper portion of the outer ear helix, and the opposed contact location is proximate the lower part of the ear or abutting head, such as near the otobasion inferius 79. Contact near the otobasion inferius 79 can be accomplished in any desired manner, for example without an arm, or with an arm that is fixed in location, or with an arm that is fixed and compliant. Body 51 can include a protrusion (in place of the arm) that is configured to contact the ear root region proximate otobasion inferius 79. In one non-limiting example the opposed contact location is in or proximate the ear root dimple 77 that is located in most heads very close to or abutting or just posterior of the otobasion inferius 79. The audio device may be compliant at the portions that define each of two (or more) expected ear/head contact locations. For example, the body 51 of the audio device may include a compliant section at the contact location proximate the upper portion of the outer ear helix.

In one non-limiting example, audio device body 51 comprises a hollow housing portion 60, which may be used to house internal electrical components, such as a battery and circuitry. In an example portion 60 is a molded plastic member. In an example portion 60 is a metal housing (e.g., stainless steel) and can have a silicone overcoat to increase comfort using a material that is appropriate for contact with the skin. Housing portion 60 has lower distal end 61. Distal end 61 is in one example located generally behind the outer ear, near the bottom of the ear, and thus is as far away as possible from the sound-emitting opening 54. Arm 56 (when present) is coupled to body 51 (e.g., to body portion 60), and may be configured to be moved relative to body 51, and/or, in implementations where arm 56 is compliant, to bend. These movements and adjustments of arm 56 relative to body 51 allow arm distal end portion 58 to be located where desired relative to body 51. In some implementations, this allows distal end 58 to be located in or near the ear root dimple. This also allows the user to achieve a desired (and variable) clamping force of audio device 50 on the head and/or ear.

In one non-limiting example, arm 56 is adjustable relative to body 51 to achieve the best fit and clamping force for the user. This adjustability of the arm is preferably but not necessarily at least up and down along the length of body portion 60, in the direction of arrow 63, FIG. 4. Also, the angular position of arm distal end 58 relative to body portion 60 can be made adjustable (e.g., to accommodate different positions of ear root dimples). Such adjustability can be accommodated by configuring the arm to bend and/or to rotate about the longitudinal axis of body portion 60. The horizontal and vertical position of arm distal end 58, and the amount of torque applied to body 51 via arm 56 and its distal end 58, can be made adjustable by configuring arm 56 such that it can be bent. Bending can be in one or both of the vertical direction and the horizontal direction. In one non-limiting example, both bending modes can be accommodated by fabricating the arm or another protrusion of an elastomer (such as a silicone or a thermoplastic elastomer) that can be bent or otherwise manipulated, for example up and down and side-to-side relative to the arm longitudinal axis. Horizontal bending can apply a torque to body 51, which can force acoustic module 52 against the head by pushing outward on the inside of the earlobe. This can help stabilize audio device 50 on the head. In some implementations, multiple sizes of arms 56 can be provided, having varying lengths of arm distal end 58. For example, a small, medium, and large size arm 56 may be used to accommodate various head/ear sizes.

Audio device body 51 can at least in part be shaped to generally follow the shape of the ear root. The anatomy of the ear and head adjacent to the ear, and manners in which an audio device can be carried on or near the ear, are further described in U.S. Patent Application Publication 2019/0261077, published on Aug. 22, 2019, the entire disclosure of which is incorporated herein by reference for all purposes. Accordingly, not all aspects of the anatomy and fitting of an audio device to an ear are specifically described herein. Body 51 in this example includes generally "C"-shaped portion 55 that extends from an upper end (which when worn on the head may be proximate otobasion superius 78) where it is coupled to acoustic module 52, to a lower end where it is coupled to portion 60. While portion 60 is shown as a separate piece from the rest of body 51, in some implementations, portion 60 and the rest of body 51 may be integrally formed. In some implementations, some or all of body 51 is compliant. For example, the portion of body 51 that comes in contact with a wearer's ear/head may be compliant. Compliance can be accomplished in one or more mechanical manners. Examples include the choice of materials (e.g., using compliant materials such as elastomers or spring steel or the like) and/or a construction to achieve compliance (e.g., including a differentially-bending member in the construction). Generally, but not necessarily, body 51 (e.g., portion 55) follows the ear root from the otobasion superius 78 (which is at the upper end of the ear root) to about the otobasion posterius (not shown).

In implementations with arm 56, arm distal end 58 can be constructed and arranged to fit into or near the dimple or depression 77 (i.e., the ear root dimple) that is found in most people behind earlobe 76 and just posterior of the otobasion inferius 79. In some implementations, distal end 58 can be generally round (e.g., generally spherical), having an arc-shaped surface that provides for an ear root dimple region contact location along the arc, thus accommodating different head and ear sizes and shapes. Alternative shapes for distal end 58 include a half sphere, truncated sphere, cone, truncated cone, cylinder, and others. Arm distal end 58 can be made from or include a compliant material (or made compliant in another manner), and so it can provide some grip to the head/ear.

In some implementations, body portion 55 at or around the ear root region proximate the upper portion 75 of the outer ear helix (which is generally the highest point of the outer ear) has compliance. Since ear portion 75 is generally diametrically opposed to ear root dimple 77 (and to device portion 58 which contacts the ear root dimple), a compliance in body portion 55 will provide a gripping force that will tend to hold audio device 50 on the head/ear even as the head is moved.

Since the device-to-ear/head contact points are, at least for most users, both in the vicinity of the ear root (proximate upper ear upper portion 75 and in the vicinity of ear root dimple 77), the contact points are generally diametrically opposed. The opposed compliances create a resultant force on the device (the sum of contact force vectors, not accounting for gravity) that lies about in the line between the opposed contact regions. In this way, the device can be held stable on the ear even in the absence of high contact friction (which adds to stabilization forces and so only helps to keep the device in place). Contrast this to a situation where the lower contact region is substantially higher up on the back of the ear. This would cause a resultant force on the device that tended to push and rotate it up and off the ear. By arranging the contact forces roughly diametrically opposed on the ear, and by creating points of contact on either side of or over an area of the upper ear root ridge 75, the device can accommodate a wider range of orientations and inertial conditions where the forces can balance, and the device can thus remain on the ear.

FIG. 4 is a rear view of the open audio device 50 shown in FIG. 3. Open audio device 50 includes microphones 82, 84, 86, and 88. Microphones 82 and 84 are located on the inside of housing 52 (e.g., on or proximate housing rear face 57 that is configured to lie against or very close to the head), and so lie close to the head and thus may be less susceptible to wind than if they were located on the outside of the housing. These two microphones lie generally along an axis that intercepts the expected location of the user's mouth (not shown) and so may be best suited for use in a beamformed array. Microphone 86 can also be on the inside of the device, close to the head, and so less susceptible to wind noise. Microphone 88 is located close to distal end 61 and may be behind the ear and so more shielded from wind noise due to forward motion of the person wearing the device (e.g., while running, walking, or biking). Microphones 86 and 88 could be used alone, or combined in some manner other than beamforming, if and when the array comprising microphones 82 and 84 is not useful due to wind noise. Note that there could be more than or fewer than four microphones in device 50, and their locations could be different than shown in the non-limiting example of FIG. 4. Since microphone 88 is the farthest from the acoustic driver, it is most likely to pick up the user's voice with minimal input from the driver. Microphone 88 may thus be useful as a reference microphone for a voice activity detector. Also, due to its distance from the acoustic driver it may be able to function without an acoustic echo canceller.

A number of implementations have been described. Nevertheless, it will be understood that additional modifications may be made without departing from the scope of the inventive concepts described herein, and, accordingly, other examples are within the scope of the following claims.

What is claimed is:

1. A method that uses a personal audio device configured to be worn on the head or body of a user and that includes a plurality of microphones configured to provide a plurality of separate microphone signals capturing audio from an environment external to the personal audio device and a processor, the method comprising using the processor to:

process a first subset comprising a plurality of the separate microphone signals using a first array processing technique, to provide a first array signal;

compare an energy level the first array signal to an energy level of a microphone signal from the plurality of separate microphone signals, wherein the comparison takes place only at frequencies of less than 1 kHz; and select the first array signal or the microphone signal based on the comparison.

2. The method of claim 1, further comprising using the processor to make a determination whether the energy level of the first array signal at frequencies of less than 1 kHz is greater than the energy level of the microphone signal at frequencies of less than 1 kHz by at least a threshold amount.

3. The method of claim 1, further comprising using the processor to select an accelerometer signal if an energy level of the first array signal at frequencies of less than 1 kHz and all of the separate microphone signals at frequencies of less than 1 kHz are above a threshold level.

4. The method of claim 1, wherein the comparison is of the first array signal to each of the microphone signals from the plurality of separate microphone signals.

5. The method of claim 4, further comprising using the processor to select the first array signal or a microphone signal of the separate microphone signals based on the comparison.

6. The method of claim 5, wherein if the energy level of the first array signal at frequencies of less than 1 kHz is greater than the energy level of any of the separate microphone signals at frequencies of less than 1 kHz, the processor selects a microphone with an energy at frequencies of less than 1 kHz lower than that of the first array.

7. The method of claim 6, wherein if the energy level of the first array signal at frequencies of less than 1 kHz is greater than the energy level of any of the separate microphone signals at frequencies of less than 1 kHz, the processor selects the microphone with the lowest energy at frequencies of less than 1 kHz.

8. The method of claim 1, wherein the selection by the processor comprises blending the first array signal and the microphone signal based on the comparison, wherein blending comprises applying a first weighting factor to the first array signal and applying a second, different weighting factor to the microphone signal, and combining the weighted signals.

9. The method of claim 8, further comprising using the processor to make a determination whether the energy level of the first array signal at frequencies of less than 1 kHz is greater than the energy level of the microphone signal at frequencies of less than 1 kHz by at least a threshold amount.

10. The method of claim 9, wherein the first array signal and the microphone signal are blended when the energy level of the first array signal at frequencies of less than 1 kHz is greater than the energy level of the microphone signal at frequencies of less than 1 kHz by least the threshold amount.

11. The method of claim 10, wherein the blending takes place over a predetermined time period.

12. The method of claim 11, wherein after the predetermined time period the blending ceases.

13. The method of claim 1, further comprising using the processor to process a second subset of the plurality of separate microphone signals to provide a second array signal based on the comparison, the first subset of the plurality of separate microphone signals being different from the second subset of the plurality of separate microphone signals.

14. The method of claim 13, wherein the second array signal is generated using a second array processing technique that is different than the first array processing technique.

15. The method of claim 1, wherein the personal audio device further includes a support structure that is configured to be coupled to an ear of the user and an acoustic module coupled to the support structure and configured to be located anteriorly of the ear, wherein there are at least two microphones carried by the acoustic module and at least one microphone carried by the support structure, wherein the support structure comprises an end spaced farthest from the acoustic module and the at least one microphone carried by the support structure is located proximate the end.

16. A method that uses a personal audio device configured to be worn on the head or body of a user and that includes a plurality of microphones configured to provide a plurality of separate microphone signals capturing audio from an environment external to the personal audio device, and a processor, the method comprising using the processor to:

process a first subset comprising a plurality of the separate microphone signals using a first array processing technique, to provide a first array signal;

compare an energy level the first array signal to an energy level of each of the microphone signals, wherein the comparison takes place only at frequencies of less than 1 kHz; and select the first array signal or one of the microphone signals based on the comparison, wherein if the energy level of the first array signal at frequencies of less than 1 kHz is greater than the energy level of any of the separate microphone signals at frequencies of less than 1 kHz the microphone with the lowest energy at frequencies of less than 1 kHz is selected, and wherein if the energy level of the first array signal at frequencies of less than 1 kHz is less than the energy level of each of the separate microphone signals at frequencies of less than 1 kHz the first array signal is selected.

* * * * *